US006581637B2

(12) United States Patent
Hamamoto et al.

(10) Patent No.: US 6,581,637 B2
(45) Date of Patent: Jun. 24, 2003

(54) TANK AND A METHOD FOR STORING AN EASILY POLYMERIZABLE COMPOUND

(75) Inventors: Kei Hamamoto, Himeji (JP); Takeshi Nishimura, Himeji (JP); Kazuhiko Sakamoto, Himeji (JP); Osamu Dodo, Hyogo-ken (JP)

(73) Assignee: Nippon Shokubai Co., Ltd., Osaka-fu (JP)

( * ) Notice: Subject to any disclaimer, the term of this patent is extended or adjusted under 35 U.S.C. 154(b) by 171 days.

(21) Appl. No.: 09/788,597

(22) Filed: Feb. 21, 2001

(65) Prior Publication Data

US 2001/0015226 A1 Aug. 23, 2001

(30) Foreign Application Priority Data

Feb. 21, 2000 (JP) ..... 2000-043410

(51) Int. Cl.[7] ..... F17D 1/14
(52) U.S. Cl. ..... 137/563; 137/590; 137/592
(58) Field of Search ..... 137/563, 590, 137/592; 366/159.1

(56) References Cited

U.S. PATENT DOCUMENTS 3,754,734 A * 8/1973 Hoyle et al. ..... 366/159.1
3,874,399 A * 4/1975 Ishihara ..... 137/563
6,414,183 B1 * 7/2002 Sakamoto et al. ..... 560/218

* cited by examiner

*Primary Examiner*—Gerald A. Michalsky
(74) *Attorney, Agent, or Firm*—Wenderoth, Lind & Ponack, L.L.P

(57) ABSTRACT

According to the present invention, a tank for storing an easily polymerizable compound, the tank fitted with a liquid inlet pipe 3, a liquid draw-off pipe 4 and a liquid recirculating pipe 5, is characterized in that, assuming terminal ends of the individual pipes 3–5 are located at the same height, the apex angle formed by a line joining the central points of the end openings of the pipe 3 and the pipe 4 at the central point of a horizontal cross section of the tank, or the apex angle formed by a line joining the central points of the pipe 5 and the pipe 4 at the central point of the horizontal cross section of the tank, is equal to or larger than 90°. A method of storing an easily polymerizable compound of the invention utilizes the aforementioned tank for storing the polymerizable compound.

20 Claims, 6 Drawing Sheets

TANK AND A METHOD FOR STORING AN EASILY POLYMERIZABLE COMPOUND

BACKGROUND OF THE INVENTION

1. Field of the Invention

The present invention relates to a tank and a method for storing an easily polymerizable compound. More particularly, the invention pertains to a tank for storing an easily polymerizable compound, such as a (meth)acrylic acid, and a method for storing the easily polymerizable compound using the tank, in which polymerization of the compound is inhibited or substantially retarded to enable stable storage thereof.

2. Description of the Prior Art

When storing an easily polymerizable compound, such as a (meth)acrylic acid, it is commonly practiced to add a polymerization inhibitor, such as hydroquinone or phenothiazine, or introduce inert gas containing molecular oxygen into a storage tank to prevent polymerization of the compound. Another conventional approach to prevent polymerization is to cool and circulate a polymerizable compound to regulate its temperature within a storage tank or to make the concentration of a polymerization inhibitor uniform within the polymerizable compound.

Even if such methods of preventing polymerization are used, however, the polymerization inevitably would occur, and it has been impossible to store an easily polymerizable compound in a stable fashion due to adhesion of a polymer or clogging of a flow channel (circulating pipe) by the polymer, making it necessary to chemically or manually remove the adhering or clogging product at regular intervals. It has therefore been an important issue to prevent polymerization within a storage tank for storing an easily polymerizable compound.

Generally, in a storage tank, a liquid taken from a production process is stored in the tank and drawn therefrom for shipment as a commercial product or for use in another production process whenever the need arises. When the stored liquid is an easily polymerizable compound, a polymerization inhibitor is added to the product to prevent its polymerization as described above. In this case, it is preferable that the concentration of the polymerization inhibitor within the polymerizable compound in the storage tank and within the polymerizable compound drawn from the storage tank be kept as uniform as possible. In other words, it is preferable that the polymerizable compound having as uniform a composition as possible can be drawn from the tank.

SUMMARY OF THE INVENTION

The invention provides a tank for storing an easily polymerizable compound, the tank fitted with a liquid inlet pipe, a liquid draw-off pipe and a liquid recirculating pipe, wherein the liquid inlet pipe and/or the liquid recirculating pipe is arranged in such a position with respect to the liquid draw-off pipe that, assuming that terminal ends of the invididual pipes are located at the same height (i.e., when viewed from above, so that height is not a consideration as to whether lines intersect with each other), the apex angle of a triangle formed by a line joining the central points of both end openings of the liquid inlet pipe and the liquid draw-off pipe and the point of intersection of horizontal lines extended individually from the central points of the end openings of the liquid inlet pipe and the liquid draw-off pipe to the central point of a horizontal cross section of the tank, or the apex angle of a triangle formed by a line joining the central points of both end openings of the liquid recirculating pipe and the liquid draw-off pipe and the point of intersection of horizontal lines extended individually from the central points of the end openings of the liquid recirculating pipe and the liquid draw-off pipe to the central point of the horizontal cross section of the tank, is equal to or larger than 90°.

The invention also provides a method of storing an easily polymerizable compound by use of the tank as defined above.

DETAILED DESCRIPTION OF THE PREFERRED EMBODIMENTS OF THE INVENTION

It is an object of the invention to provide a tank for storing an easily polymerizable compound and a method for storing an easily polymerizable compound using the tank which make it possible to prevent polymerization of the easily polymerizable compound during its storage and to draw the polymerizable compound with its composition made as uniform as possible.

The inventors have found that if mixability of an easily polymerizable compound and a polymerization inhibitor in a polymerizable compound storage tank is increased or hold-up parts formed in or around the tank are decreased, the resultant mixture stored in the storage tank becomes uniform in composition and temperature distribution therein, making it possible to effectively prevent polymerization and draw the polymerizable compound having a uniform composition from the storage tank. The inventors have also found that if a liquid inlet pipe or a liquid recirculating pipe, or both, are provided at specific positions in relation to a liquid draw-off pipe of a polymerizable compound storage tank, it becomes possible to increase the mixability of an easily polymerizable compound and decrease hold-up parts formed in or around the storage tank.

While the invention is described, by way of example, with reference to the accompanying drawings, it is to be noted that these drawings provide only a schematic representation of one preferred embodiment of the invention and are not intended to limit the mode of carrying out the invention to any specific apparatus or method illustrated therein.

Figure 1:
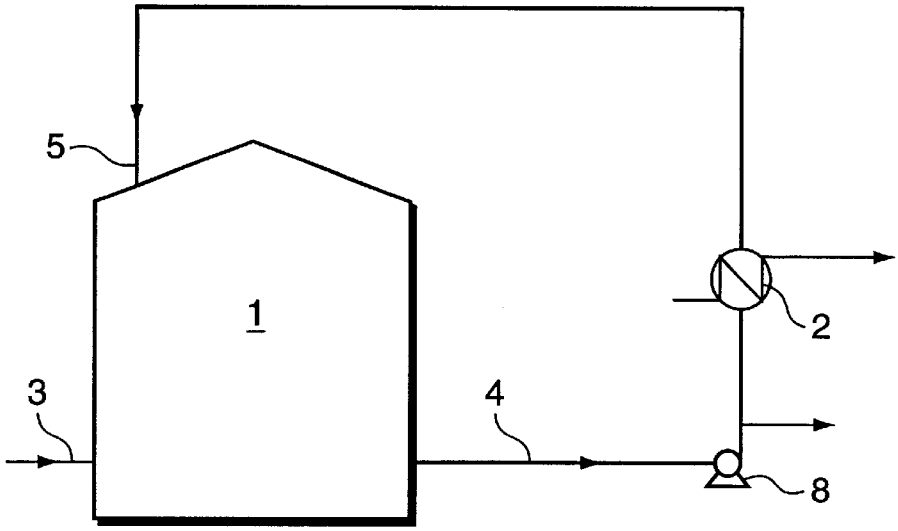
FIG. 1 is a schematic diagram of a polymerizable compound storage tank in accordance with one embodiment of the invention.

FIG. 1 is a schematic diagram of a polymerizable compound storage tank 1 in accordance with one embodiment of the invention. As shown in FIG. 1, the polymerizable compound storage tank 1 of the invention is connected with a liquid inlet pipe 3 for introducing an easily polymerizable compound (which may often be referred to hereinafter as "the stored liquid" or "the liquid") into the tank 1, a liquid draw-off pipe 4 for drawing the stored liquid from the tank 1, and a liquid recirculating pipe 5 for recirculating part or the whole of the liquid taken from the liquid draw-off pipe 4 back into the tank 1.

The liquid taken from the liquid draw-off pipe 4 is caused to flow through the liquid recirculating pipe 5 by a circulating pump 8 provided at any desired location in the circuit. The temperature of the liquid taken from the liquid draw-off pipe 4 is adjusted by a heat exchanger 2 provided also at any desired location and returned to the storage tank 1.

Since part or the whole of the liquid taken from the liquid draw-off pipe 4 is recirculated to the tank 1 after undergoing a heat-exchange process, it becomes possible to regulate the temperature of the liquid stored in the tank 1 and to effectively prevent its polymerization which may occur due to temperature increase. Furthermore, as will be described later, it becomes possible to make the concentration of a polymerization inhibitor within the easily polymerizable compound in the tank 1 uniform by locating the individual pipes 3–5 in a specific fashion.

Generally, it is preferable to introduce molecular oxygen gas into a liquid-phase section and/or a vapor-phase section of the liquid stored in the tank 1 to prevent polymerization. It is also preferable to add a commonly used polymerization inhibitor to the liquid in the tank 1.

The method of introducing the molecular oxygen gas or the polymerization inhibitor is not specifically limited. For example, the molecular oxygen gas or the polymerization inhibitor may be introduced using a dedicated inlet pipe connected to the tank 1 or previously added to the stored liquid introduced through the liquid inlet pipe 3.

The polymerizable compound storage tank 1 of the invention may be of any convenient shape which is commonly used for storing chemical products. Generally, tanks having a circular or square shape in horizontal cross section are often used. In this invention, a vertical cylindrical tank, for example, can be conveniently employed. The shape of a roof at the top of the tank 1 is not particularly limited either. For example, the tank 1 may be a cone-roof or dome-roof tank.

Furthermore, ancillary devices used in the invention, such as the heat exchanger 2 and the circulating pump 8, are not limited to specific types or constructions. Rather, such ancillary devices may be chosen as appropriate from those commonly used in the chemical industry. To cite a few examples, the heat exchanger 2 may be a multitube, coil-in-box or spiral-plate heat exchanger, and the circulating pump 8 may be a centrifugal volute pump, rotary pump, screw pump or leakage-free pump. A canned motor pump, one type of leakage-free pump, having no shaft seal part for restricting liquid leakage through a pump shaft hole in a pump casing can be conveniently used in this invention.

The position where the liquid recirculating pipe 5 is connected to the tank 1 is not particularly limited. For example, the liquid recirculating pipe 5 may be connected to the roof or a side wall of the tank 1. The liquid inlet pipe 3 and the liquid draw-off pipe 4 are connected to the side wall of the tank 1. Ends of these pipes 3–5 may, or may not, extend into the interior of the tank 1.

What is characteristic of this invention is that the liquid inlet pipe 3 or the liquid recirculating pipe 5, or both, are provided to open at specific positions in relation to the liquid draw-off pipe 4 in the above-described polymerizable compound storage tank 1.

Figure 2:
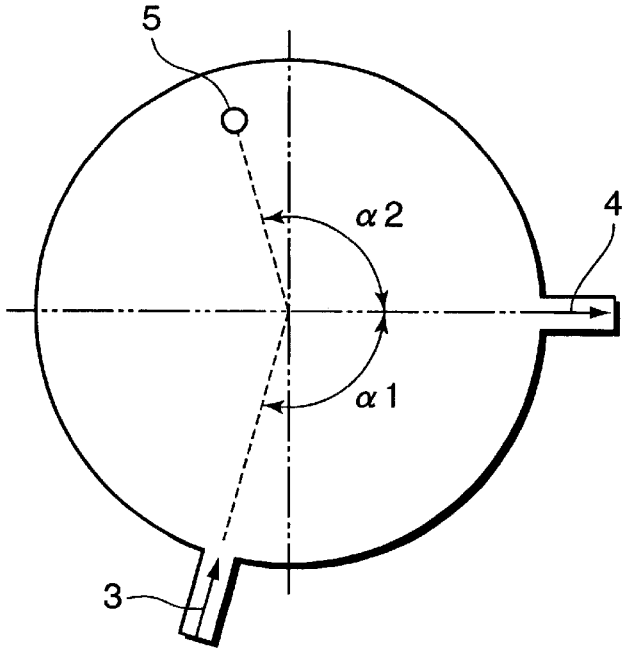
FIG. 2 is a horizontal cross section of the polymerizable compound storage tank in accordance with one embodiment of the invention showing the relationship among the positions where a liquid inlet pipe, a liquid draw-off pipe and a liquid recirculating pipe are connected to the tank to open therein.

FIG. 2 is a horizontal cross section of the polymerizable compound storage tank 1 in accordance with one embodiment of the invention showing the relationship among the positions where the liquid inlet pipe 3, the liquid draw-off pipe 4 and the liquid recirculating pipe 5 are connected to the tank 1. The liquid recirculating pipe 5 is connected to the roof of the tank 1 (shown by a small circle) while the liquid inlet pipe 3 and the liquid draw-off pipe 4 are connected to the side wall of the tank 1.

Assuming that the end of the liquid inlet pipe 3 (i.e., the center of its opening directed into the tank 1) and the end of the liquid draw-off pipe 4 (i.e., the center of its opening directed into the tank 1) are located in the same horizontal plane (i.e., as viewed from above, so that height is not a consideration as to whether lines intersect with each other), it is recommended in this invention that the liquid inlet pipe 3 be provided such that a central angle $\alpha 1$ (apex angle) of a triangle formed by a line (base) joining both ends of the liquid inlet pipe 3 and the liquid draw-off pipe 4 and the point of intersection of horizontal lines extended individually from the ends of the liquid inlet pipe 3 and the liquid draw-off pipe 4 to the central point of the horizontal cross section of the tank 1 (lying in the aforementioned horizontal plane) becomes at least 90°, more preferably equal to or larger than 120°. It becomes possible to prevent formation of a short path of the stored liquid and increase the mixability of the easily polymerizable compound and the polymerization inhibitor by providing the liquid inlet pipe 3 and the liquid draw-off pipe 4 in this manner.

Similarly, if the liquid recirculating pipe 5 is provided such that central angle $\alpha 2$ (apex angle) of a triangle formed by a line (base) joining both ends of the liquid recirculating pipe 5 and the liquid draw-off pipe 4 and the point of intersection of horizontal lines extended individually from the ends of the liquid recirculating pipe 5 and the liquid draw-off pipe 4 to the central point of the horizontal cross section of the tank 1 becomes at least 90°, more preferably equal to or larger than 120°, it is possible to prevent formation of a short path of the stored liquid and increase the mixability of the easily polymerizable compound and the polymerization inhibitor.

It should be understood from the foregoing that the pipes 3–5 should be located such that the central angle $\alpha 1$ formed by two lines extended from the liquid inlet pipe 3 and the liquid draw-off pipe 4, or the central angle $\alpha 2$ formed by two lines extended from the liquid recirculating pipe 5 and the liquid draw-off pipe 4, falls within the aforementioned range according to the invention. To obtain greater effects of preventing formation of a short path and increasing the mixability, however, the pipes 3–5 should preferably be located such that both the central angle α1 and the central angle α2 fall within the aforementioned range.

Figure 6A:
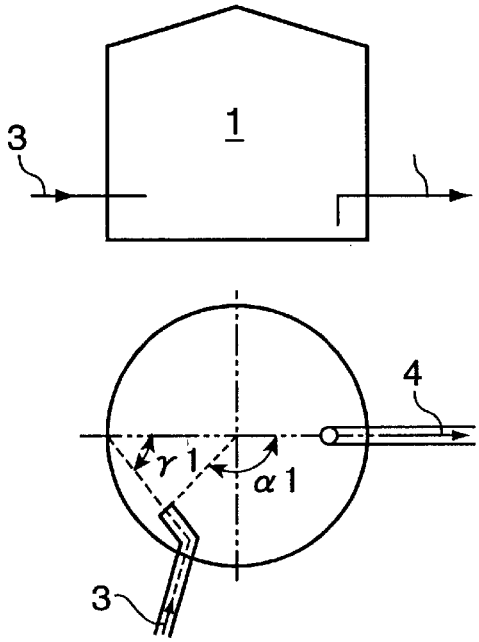
FIGS. 6A–6D show vertical and horizontal cross sections of preferred forms of polymerizable compound storage tanks in accordance with one embodiment of the invention.
Figure 6B:
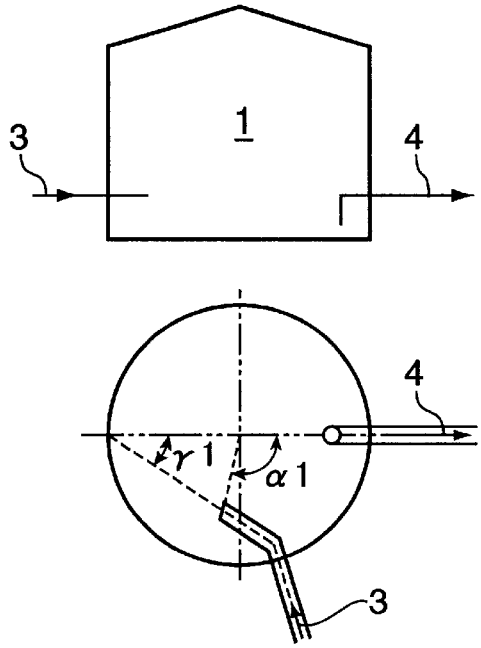
Figure 6C:
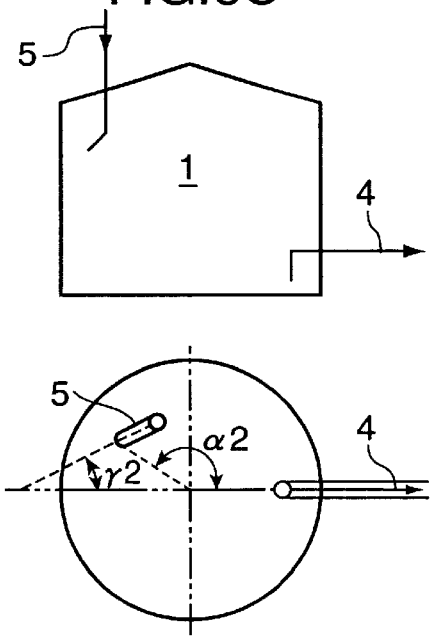
Figure 6D:
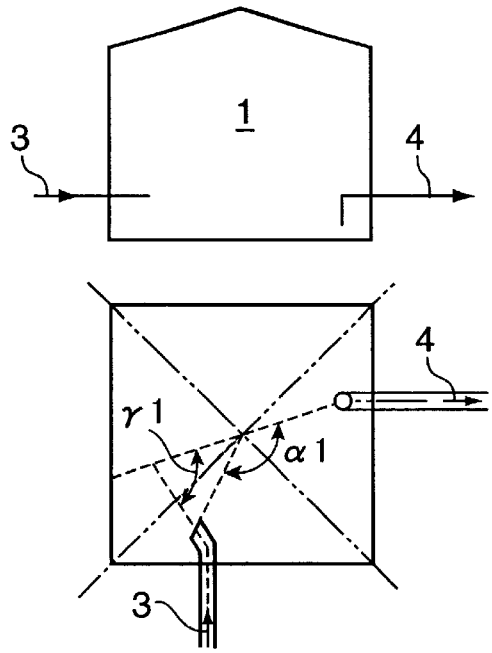

In this invention, the central angles α1 and α2 are formed by the lines which connect the central points of the openings of the individual pipes 3–5 to the central point of the horizontal cross section of the tank 1. If the polymerizable compound storage tank 1 is a cylindrical tank having a circular cross section as shown in FIG. 2, for example, the central angle α1 is formed by the line horizontally connecting the center of the end opening of the liquid inlet pipe 3 to the central point of the horizontal cross section of the tank 1 and the line horizontally connecting the center of the end opening of the liquid draw-off pipe 4 to the central point of the horizontal cross section of the tank 1. If the polymerizable compound storage tank 1 is of a type having a quadrangular horizontal cross section as shown in FIG. 6D, the central point of the tank 1 lies at the point of intersection of two lines joining opposite vertices of the horizontal cross section. In this case, the central angle α1 is an angle formed by the lines horizontally connecting the central point of the tank 1 to the central points of the end openings of the pipes 3 and 4.

Although the pipes 3–5, whichever connected to the side wall of the tank 1, may be connected thereto at any desired heights, that is, they need not necessarily be connected in the same horizontal plane, an assumption is made that the central points of the openings of the pipes 3–5 and the central point of the horizontal cross section of the tank 1 lie in the same horizontal plane at a given height when calculating the central angles α1 and α2.

Figure 3:
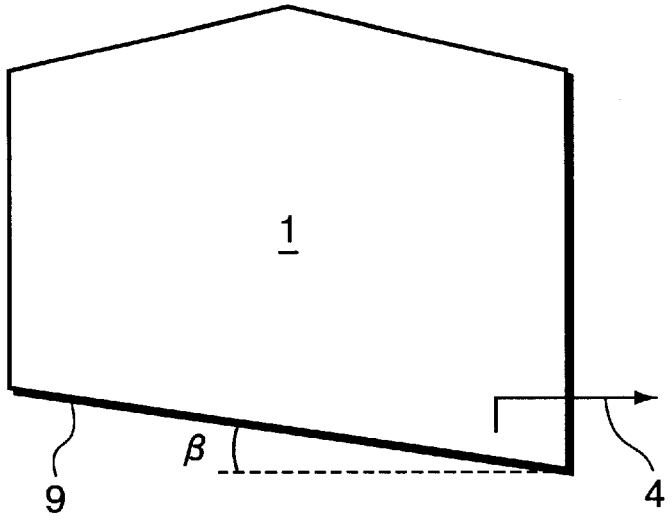
FIG. 3 is a schematic diagram showing one form of the polymerizable compound storage tank in accordance with one embodiment of the invention.

In the polymerizable compound storage tank 1 of the invention, it is preferable that bottom 9 (bottom plate) of the tank 1 slope downward toward the liquid draw-off pipe 4 as depicted in FIG. 3. While angle β of downward inclination of the tank bottom 9 is not specifically limited, its gradient should preferably be equal to or larger than 1/200, more preferably be equal to or larger than 1/100, and even more preferably be equal to or less than 1/10. If the tank bottom 9 slopes in this way, it becomes possible to effectively draw off the stored liquid, reduce the amount of liquid that remains without flowing in the tank 1, and further improve the mixability of the polymerizable compound and the polymerization inhibitor.

The method of forming such a gradient (β) in the tank bottom 9 is not specifically limited. As an example, a concrete foundation may be prepared to have a desired gradient (β) prior to installing a storage tank.

Figure 4:
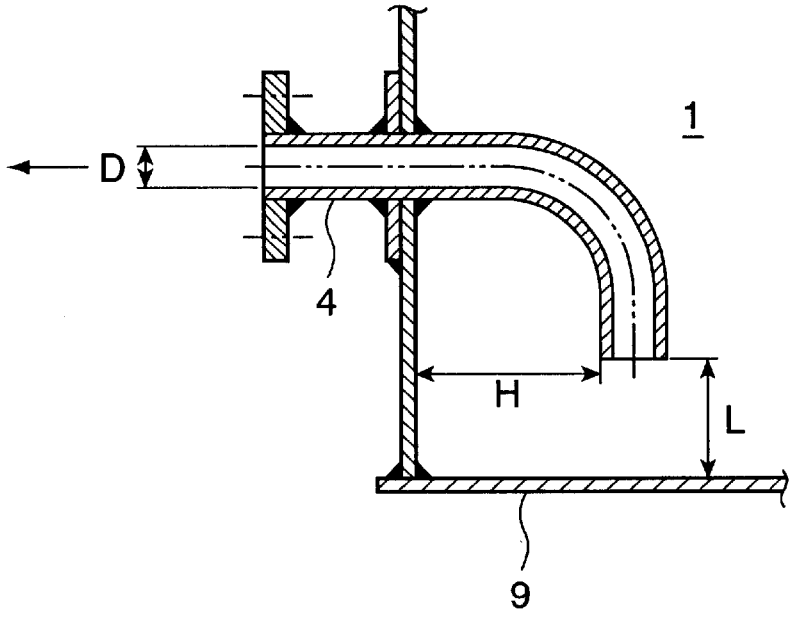
FIG. 4 is a vertical cross-sectional view of a liquid draw-off pipe having a bend in accordance with one embodiment of the invention.

In the storage tank 1 of this invention, if the liquid draw-off pipe 4 is connected to the tank 1 at a position higher than its bottom 9, it is preferable that the end of the liquid draw-off pipe 4 extend into the tank 1 assuming a curved shape such that the end of the liquid draw-off pipe 4 opens face to face with the tank bottom 9 as shown in FIG. 4.

The curved shape reduces the amount of stiffeners that reinforce the durability of the liquid draw-off pipe 4, also suppresses the cracks in welds and reduces the amount of liquid that remains without flowing in the tank 1.

This arrangement of the liquid draw-off pipe 4 makes it possible to reduce the amount of liquid that remains without flowing in the tank 1 and further improve the mixability of the stored liquid. Here, it is preferable to dispose the liquid draw-off pipe 4 such that its end opening is directed toward the tank bottom 9 and, in particular, at right angles to the tank bottom 9, which can effectively reduce the amount of liquid that remains without flowing in the tank 1.

Furthermore, it is desirable that the distance L between the end of the liquid draw-off pipe 4 and the tank bottom 9 falls within a range of 0.5 D to 2 D, where D is the inside diameter of the liquid draw-off pipe 4. If the distance L between the end of the liquid draw-off pipe 4 and the tank bottom 9 is too small, the fluidity of the stored liquid will be degraded. If the distance L is too large, on the other hand, the mixability of the stored liquid will be degraded due to an increase in dead space and the stored liquid will become more likely to be held up, resulting in an increase in the risk of polymerization.

The distance H between the inner wall side end of the liquid drawn off pipe 4 and the tank center side end of the liquid draw off pipe 4 is preferably in the range of 50 mm to 500 mm. If the distance H is 50 mm or more, ease of maintenance and welding of the pipe 4 can be obtained. If the pipe distance H is 500 mm or less, the amount of the liquid that remains without flowing in the tank 1 can be easily reduced. The most preferable distance H is in the range of 1.1 D to 5 D. If the distance H is 1.1 D or more, generally used pipes can easily be employed as the liquid draw-off pipe 4, and this provides an advantage in cost. If the distance H is 5 D or shorter, the amount of the liquid that remains without flowing in the tank 1 can be effectively reduced.

Figure 5:
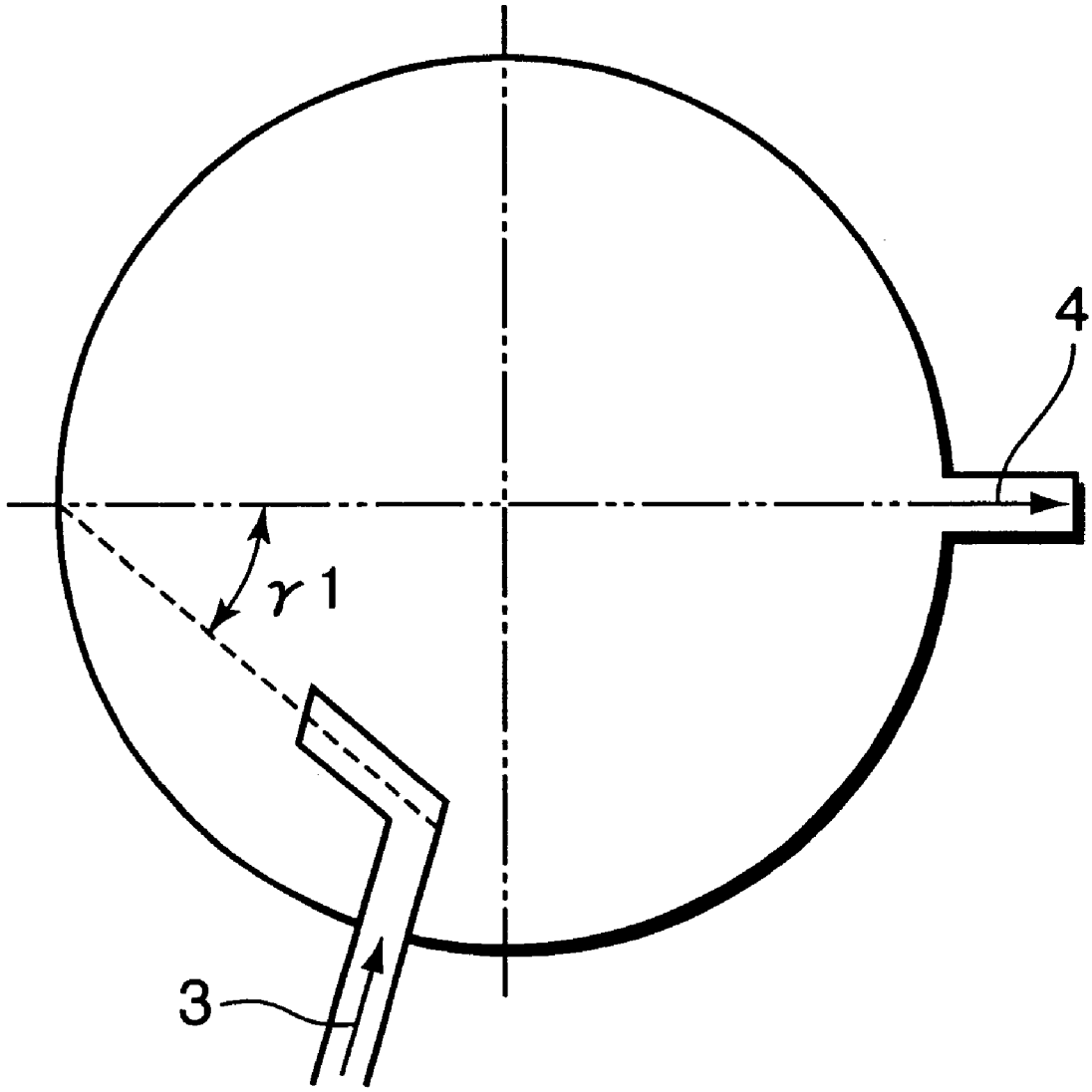
FIG. 5 is a horizontal cross-sectional view showing in which direction the liquid inlet pipe is to be bent in accordance with one embodiment of the invention.

In the storage tank 1 of the invention, it is recommended that the liquid inlet pipe 3 extend into the tank 1 and its end be arranged such that angle γ1 formed by an extension of a horizontal line joining the center of the end opening of the liquid draw-off pipe 4 and the central point of the horizontal cross section of the tank 1 and a horizontal line extended from the center of the end opening of the liquid inlet pipe 3 in its liquid-introducing direction depicted in FIG. 5, or the apex angle γ1 of a triangle whose base is the line joining the end openings of the pipes 3 and 4, preferably falls within a range of 0° to 90°, more preferably 20° or more and 80° or less, regardless of whether the apex exists inside or outside the tank 1. In order for the angle γ1 to meet this requirement, the liquid inlet pipe 3 may be bent inside the tank 1 in such a way that its end opens in the extension direction of a horizontal line joining the center of the end opening of the liquid draw-off pipe 4 as illustrated in FIG. 5. The opening of the pipe 3 may be facing up or may be facing down which is not specifically limited.

It is to be noted that the liquid inlet pipe 3 may be sharply bent such that it is formed of straight pipe segments having no curved section as shown in FIG. 5, or have a curved pipe segment like the liquid draw-off pipe 4 of FIG. 4.

If the liquid inlet pipe 3 and the liquid draw-off pipe 4 are arranged such that the angle γ1 falls within the aforementioned range, it becomes possible to reduce the amount of liquid that remains without flowing in the tank 1 and further improve the mixability of the stored liquid.

Furthermore, it is recommended that the liquid recirculating pipe 5 extend into the tank 1 and its end be arranged such that apex angle γ2 formed by the extension of the horizontal line joining the center of the end opening of the liquid draw-off pipe 4 and the central point of the horizontal cross section of the tank 1 and a horizontal line extended from the center of the end opening of the liquid recirculating pipe 5 in its liquid-introducing direction, or the apex angle γ2 of a triangle whose base is the line joining the end openings of the pipes 3 and 5, preferably falls within a range of 0° to 90°, more preferably 20° or more and 80° or less, regardless of whether the apex exists inside or outside the tank 1.

In this case, the liquid recirculating pipe 5 should be arranged in the same way as the apex angle γ1 is formed by the liquid inlet pipe 3 and the liquid draw-off pipe 4 as described above.

It becomes possible to reduce the amount of liquid that remains without flowing in the tank 1, to prevent formation of a short path of the stored liquid, to prevent the swirl flow of the liquid in the tank and increase the mixability of the easily polymerizable compound and the polymerization inhibitor by arranging the liquid recirculating pipe 5 and the liquid draw-off pipe 4 as above described angle γ2.

According to the invention, it is preferable that the aforementioned requirements for both the angle γ1 and the angle γ2 be met at the same time.

To obtain greater effects of preventing formation of a short path, preventing the swirl flow, reducing the amount of liquid that remains without flowing in the tank and increasing the mixability, the pipes 3–5 should preferably be located such that both the angle γ1 and the angle γ2 fall within the aforementioned range.

Figure 7:
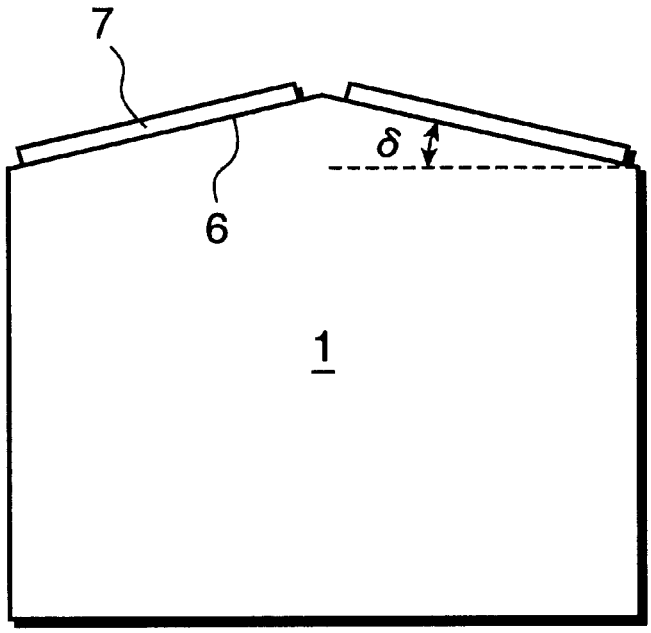
FIG. 7 is a vertical cross-sectional view of the polymerizable compound storage tank, particularly showing its preferred roof structure in accordance with one embodiment of the invention.

While the roof of the storage tank 1 is not limited to any specific type or construction, it is preferable to use self-supporting roof plates 6 associated with rafters 7 provided on the outside of the roof as shown in FIG. 7. By using the self-supporting roof plates 6 and thereby eliminating the need for providing supports within the tank 1, it is possible to prevent a decrease in the mixability of the stored liquid and formation of hold-up parts which might be caused by such supports. This approach is preferable because it effectively prevents polymerization of the stored liquid. In addition, the construction of FIG. 7 is preferable because provision of the rafters 7 on the outside of the roof is effective for preventing polymerization in the vapor-phase section or the liquid-phase section of the liquid stored in the tank 1.

While angle δ of slope of the roof plates 6 is not specifically limited, their gradient should preferably be set to fall within a range of ⅙ to ¾, more preferably ⅙ to ½, in conformity with Japanese Industrial Standard (JIS) B8501.

Furthermore, in the polymerizable compound storage tank 1 of the present invention, it is desirable to reduce the number of protrusions and hollows on inside wall surfaces of the tank 1 itself (including its bottom plate, side wall and roof plates) and ancillary devices, such as the liquid draw-off pipe 4, the liquid recirculating pipe 5 and the heat exchanger 2, as much as possible. If it is absolutely necessary to install a manhole or instruments, for example, it is preferable to make their physical dimensions as small as possible. It is possible to reduce the amount of liquid that remains without flowing in the tank 1 and enhance the fluidity and mixability of the stored liquid by substantially eliminating protrusions and hollows on the inside wall surfaces of the tank 1 as seen above.

Figure 8:
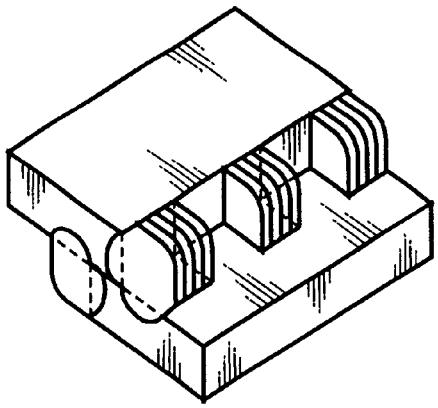
FIG. 8 is a perspective view showing an example of double-sided discontinuous lap welding.
Figure 9:
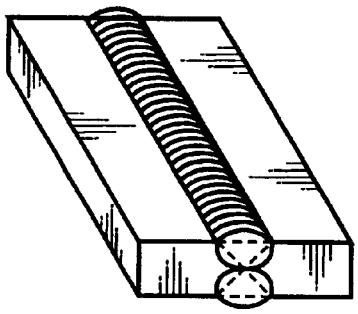
FIG. 9 is a perspective view showing an example of double-sided continuous butt welding.
Figure 10:
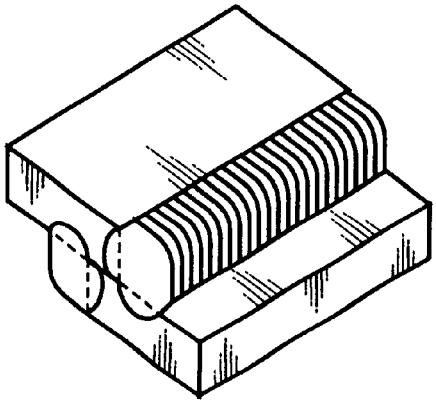
FIG. 10 is a perspective view showing an example of double-sided continuous lap welding.

In order to substantially eliminate protrusions and hollows on the inside wall surfaces of the tank 1, it would be necessary to choose appropriate welding methods for individual joints of its structural members, for instance. Generally, a double-sided discontinuous lap welding method as illustrated in FIG. 8 is undesirable because there are formed intermittently occurring hollows. In contrast, double-sided continuous butt welding and double-sided continuous lap welding are desirable because these welding methods can substantially eliminate hollows. Here, it is preferable to smoothen weld surfaces using a grinder, for instance, until beads disappear.

The aforementioned structural members of the tank 1 include the bottom plate, the side wall, the roof plates and other members provided inside the tank 1, as well as the liquid inlet pipe 3, the liquid draw-off pipe 4 and the liquid recirculating pipe 5. The liquid draw-off pipe 4 should also be welded continuously as illustrated in FIG. 4, for example, to eliminate hollows.

The welding method to be used in the invention is not specifically limited. Any appropriate welding methods including shielded arc welding, automatic arc welding, tungsten inert gas (TIG) welding, metal inert gas (MIG) welding and metal active gas (MAG) welding, for example, may be used.

Moreover, it is preferable that the inside wall surfaces of the tank 1 have a surface roughness equal to or smaller than Rmax 12.5S as defined in JIS B0601. To achieve this, a surface treatment method, such as buffing or electropolishing, may be used.

It is preferable that the storage tank 1 of this invention be designed such that a liquid recirculating line from the opening of the liquid draw-off pipe 4 into the tank 1 to the opening of liquid recirculating pipe 5 into the tank 1 does not unnecessarily branch or become unnecessarily long to decrease hold-up parts which might be formed in the liquid recirculating line.

Material to be used for constructing the storage tank 1 of the invention is not specifically limited. A commonly used stainless steel, for example, may be used for the storage tank 1.

A method of storing an easily polymerizable compound of the invention utilizes the above-described polymerizable compound storage tank 1.

Typical polymerizable compounds to which the present invention is applicable include (meth)acrylic acids and their esters, such as methyl (meth)acrylate, ethyl (meth)acrylate, n-butyl (meth)acrylate and hydroxypropyl (meth)acrylate. In the context of the present specification of the invention, storage of an easily polymerizable compound refers to storage of any one or a mixture of these compounds, or of a liquid containing any of these compounds.

The method of storing an easily polymerizable compound of the invention can be carried out in the same way as commonly practiced storage methods except in that the aforementioned polymerizable compound storage tank 1 is used. Needless to say, it is preferable to add a polymerization inhibitor and molecular oxygen according to the conventional methods.

It is possible to use a conventionally known polymerization inhibitor, such as hydroquinone or phenothiazine, in this invention as well. Molecular oxygen is usually added in the form of a gaseous mixture containing molecular oxygen and an inert gas like nitrogen. With this arrangement, it becomes possible to effectively prevent polymerization in the vapor-phase section or the liquid-phase section in the tank 1. More specifically, it is recommendable to add a gas containing molecular oxygen such that oxygen concentration within the vapor-phase section in the tank 1 falls within a range of 5% to 9% by volume. Preferably, a gaseous mixture with an oxygen concentration of 5% to 9% by volume should be added at a rate of 1 volume % or more of the total tank volume per hour, more preferably at a rate of 2 to 10 volume % per hour.

According to the storage method of the present invention, when part or the whole of the liquid drawn through the liquid draw-off pipe 4 and cooled by the heat exchanger 2 has been recirculated to the tank 1, the temperature of the liquid in the tank 1 should preferably fall within a range of 15° C. to 50° C., more preferably within a range of 15° C. to 30° C.

In the storage method of the present invention, it is preferable that the liquid drawn from the tank 1 be circulated as soon as possible to reduce the amount of liquid that remains without flowing in the tank 1. Specifically, liquid circulating time given by the following equation should preferably be 0.1 to 50 hours, more preferably 0.2 hours or more and 30 hours or less:

Liquid circulating time=(amount of liquid in tank)/(amount of circulating liquid per hour)

While the invention is described in detail below with reference to a specific example, this example is not intended to limited the invention. Various changes and modifications of the foregoing embodiment and specific examples described therein are to be taken as being included in the technical scope of the present invention.

EXAMPLES

Now, the invention is described in further detail with reference to specific examples thereof.

Example 1

A tank 1 fitted with a liquid inlet pipe 3 (having a curved section), a liquid draw-off pipe 4 (having a curved section) and a liquid recirculating pipe 5 as illustrated in FIG. 1 was installed in compliance with the following conditions:

(a) The central angle $\alpha 1$ formed by extensions of the liquid inlet pipe 3 and the liquid draw-off pipe 4 was 150°;

(b) The downslope gradient $\beta$ of the tank bottom 9 was 1/100;

(c) The distance L between the end of the liquid draw-off pipe 4 and the tank bottom 9 was 40 mm (where the inside diameter D of the liquid draw-off pipe 4 was 50 mm);

(d) The angle $\gamma 1$ that the liquid draw-off pipe 4 makes with the liquid inlet pipe 3 was 45°; and (e) The double-sided continuous lap welding method was used for welding in the tank 1.

A liquid mixture of 98% by weight of acrylic acid and 2% by weight of acetic acid (total volume 200 $m^3$) was stored in this self-supporting cone-roof tank 1 which was constructed mainly of stainless steel (SUS304) and had a capacity of 300 $m^3$, in which the mixture was continuously circulated while cooling by use of a heat exchanger 2 and a pump 8. In this Example, the following storage conditions were met:

(f) The temperature in the tank 1 was maintained at 20° C.;

(g) The amount of molecular oxygen-containing gas was added at a rate of 6 $Nm^3/h$;

(h) The mixture was circulated at a rate of 20 $m^3/h$; and (i) The liquid circulating time was 10 hours.

The liquid mixture was stored for a period of six months while operating the tank 1 under the aforementioned conditions. The tank 1 was stopped after the six-month continuous operation, and subsequent inspection of the interior of the tank 1 revealed no signs of generation or adhesion of a polymer in its vapor-phase section or liquid-phase section.

Comparative Example 1

The same liquid mixture as used in Example 1 above was stored in a storage tank 1 which was identical to the tank 1 of Example 1 except that:

(a) The central angle $\alpha 1$ formed by extensions of the liquid inlet pipe 3 and the liquid draw-off pipe 4 was set to 45° instead of 150°.

The tank 1 was stopped after one month of continuous operation, and subsequent inspection of the interior of the tank 1 revealed accumulation of large quantities of a polymer in its liquid-phase section, particularly at locations farther away from the liquid inlet pipe 3.

Since the liquid inlet pipe 3 and/or the liquid recirculating pipe 5 is provided at a specific position in relation to the liquid draw-off pipe 4 in the aforementioned polymerizable compound storage tank 1 of the invention, mixability of the easily polymerizable compound is increased and the possibility of formation of hold-up parts in the tank is decreased. As a consequence, it becomes possible to effectively prevent polymerization of the compound within the tank and to draw the polymerizable compound with its composition made uniform.

This application is based on Japanese Patent application No. 2000-43410 dated Feb. 21, 2000, the contents of which are hereby incorporated by reference.

What is claimed is:

1. A tank for storing an easily polymerizable compound, the tank fitted with a liquid inlet pipe, a liquid draw-off pipe and a liquid recirculating pipe, wherein at least one of the liquid inlet pipe and the liquid recirculating pipe is arranged in such a position with respect to the liquid draw-off pipe that, when viewed from above, the apex angle of a triangle formed by a line joining the central points of both end openings of the liquid inlet pipe and the liquid draw-off pipe and the point of intersection of horizontal lines extended individually from the central points of the end openings of the liquid inlet pipe and the liquid draw-off pipe to the central point of a horizontal cross section of the tank, is equal to or larger than 90°.

2. The tank according to claim 1, wherein a bottom of the tank slopes downward toward the liquid draw-off pipe.

3. The tank according to claim 2, wherein the end opening of the liquid draw-off pipe is located at a higher position than the bottom of the tank and the liquid draw-off pipe is curved inside the tank such that the end of the liquid draw-off pipe opens face to face with the bottom of the tank.

4. The tank according to claim 1, wherein the end opening of the liquid draw-off pipe is located at a higher position than a bottom of the tank and the liquid draw-off pipe is curved inside the tank such that the end of the liquid draw-off pipe opens face to face with the bottom of the tank.

5. The tank according to claim 3, wherein the distance L between the end opening of the liquid draw-off pipe and the bottom of the tank falls within a range of 0.5 D to 2 D, where D is the inside diameter of the liquid draw-off pipe.

6. The tank according to claim 1, wherein the liquid inlet pipe and the liquid draw-off pipe are arranged such that, when viewed from above, the angle formed by the horizontal line joining the central point of the end opening of the liquid draw-off pipe and the central point of the horizontal cross section of the tank and a horizontal line extended from the central point of the end opening of the liquid inlet pipe in its liquid-introducing direction falls within a range of 0° to 90°.

7. The tank according to claim 1, wherein the liquid recirculating pipe and the liquid draw-off pipe are arranged such that, when viewed from above, the angle formed by the horizontal line joining the central point of the end opening of the liquid draw-off pipe and the central point of the horizontal cross section of the tank and a horizontal line extended from the central point of the end opening of the liquid recirculating pipe in its liquid-introducing direction falls within a range of 0° to 90°.

8. The tank according to claim 1, wherein at least one of: inside wall surfaces of the tank; and the pipes that come in contact with the easily polymerizable compound, are smooth.

9. The tank according to claim 1, wherein the easily polymerizable compound is at least one compound selected from the group consisting of (meth)acrylic acids and esters thereof.

10. A method of storing an easily polymerizable compound by use of the tank as defined in claim 1.

11. A tank for storing an easily polymerizable compound, the tank fitted with a liquid inlet pipe, a liquid draw-off pipe and a liquid recirculating pipe, wherein at least one of the liquid inlet pipe and the liquid recirculating pipe is arranged in such a position with respect to the liquid draw-off pipe that, when viewed from above, the apex angle of a triangle formed by a line joining the central points of both end openings of the liquid recirculating pipe and the liquid draw-off pipe and the point of intersection of horizontal lines extended individually from the central points of the end openings of the liquid recirculating pipe and the liquid draw-off pipe to the central point of the horizontal cross section of the tank, is equal to or larger than 90°.

12. The tank according to claim 11, wherein a bottom of the tank slopes downward toward the liquid draw-off pipe.

13. The tank according to claim 11, wherein the end opening of the liquid draw-off pipe is located at a higher position than a bottom of the tank and the liquid draw-off pipe is curved inside the tank such that the end of the liquid draw-off pipe opens face to face with the bottom of the tank.

14. The tank according to claim 12, wherein the end opening of the liquid draw-off pipe is located at a higher position than the bottom of the tank and the liquid draw-off pipe is curved inside the tank such that the end of the liquid draw-off pipe opens face to face with the bottom of the tank.

15. The tank according to claim 13, wherein the distance L between the end opening of the liquid draw-off pipe and the bottom of the tank falls within a range of 0.5 D to 2 D, where D is the inside diameter of the liquid draw-off pipe.

16. The tank according to claim 11, wherein the liquid inlet pipe and the liquid draw-off pipe are arranged such that, when viewed from above, the angle formed by the horizontal line joining the central point of the end opening of the liquid draw-off pipe and the central point of the horizontal cross section of the tank and a horizontal line extended from the central point of the end opening of the liquid inlet pipe in its liquid-introducing direction falls within a range of 0° to 90°.

17. The tank according to claim 11, wherein the liquid recirculating pipe and the liquid draw-off pipe are arranged such that, when viewed from above, the angle formed by the horizontal line joining the central point of the end opening of the liquid draw-off pipe and the central point of the horizontal cross section of the tank and a horizontal line extended from the central point of the end opening of the liquid recirculating pipe in its liquid-introducing direction falls within a range of 0° to 90°.

18. The tank according to claim 11, wherein at least one of: inside wall surfaces of the tank; and the pipes that come in contact with the easily polymerizable compound, are smooth.

19. The tank according to claim 11, wherein the easily polymerizable compound is at least one compound selected from the group consisting of (meth)acrylic acids and esters thereof.

20. A method of storing an easily polymerizable compound by use of the tank as defined in claim 11.

* * * * *